United States Patent [19]

Ingham, Jr.

[11] 4,117,656

[45] Oct. 3, 1978

[54] HANDLING YARN IN A COMBINATION FALSE TWIST AND CO-MINGLING JET APPARATUS

[75] Inventor: Robert M. Ingham, Jr., Spartanburg, S.C.

[73] Assignee: Milliken Research Corporation, Spartanburg, S.C.

[21] Appl. No.: 843,078

[22] Filed: Oct. 17, 1977

[51] Int. Cl.[2] ..... D02G 1/20; D01H 9/14; D01H 11/00

[52] U.S. Cl. ..... 57/157 TS; 57/34.5; 57/54; 226/97; 28/272

[58] Field of Search ..... 57/34 R, 34.5, 157 TS, 57/34 HS, 157 F, 52, 53, 54; 28/272, 274–276; 226/7, 97

[56] References Cited

U.S. PATENT DOCUMENTS

| | | | |
|---|---|---|---|
| 3,363,294 | 1/1968 | Jeurissen et al. | 28/272 |
| 3,423,000 | 1/1969 | Heinen | 57/34.5 X |
| 3,577,721 | 5/1971 | Schmick et al. | 28/272 X |
| 3,750,922 | 8/1973 | Bethea et al. | 28/272 X |
| 3,837,052 | 9/1974 | Martin et al. | 28/272 |
| 3,971,108 | 7/1976 | Gorrafa | 28/272 |
| 4,051,581 | 10/1977 | Biot et al. | 28/272 |

*Primary Examiner*—John Petrakes
*Attorney, Agent, or Firm*—Earle R. Marden; H. William Petry

[57] ABSTRACT

The combination of a suction device to maintain yarn flow through a co-mingling jet apparatus during doffing of a completed yarn package. The co-mingling jet is an air jet employing an air inlet substantially perpendicular to the thread line through the jet.

1 Claim, 5 Drawing Figures

HANDLING YARN IN A COMBINATION FALSE TWIST AND CO-MINGLING JET APPARATUS

It is an object of the invention to provide an apparatus which allows continuous operation of a co-mingling jet apparatus during doffing.

Other objects and advantages of the invention will become clearly apparent as the specification proceeds to describe the invention with reference to the accompanying drawings, in which.

Figure 1:
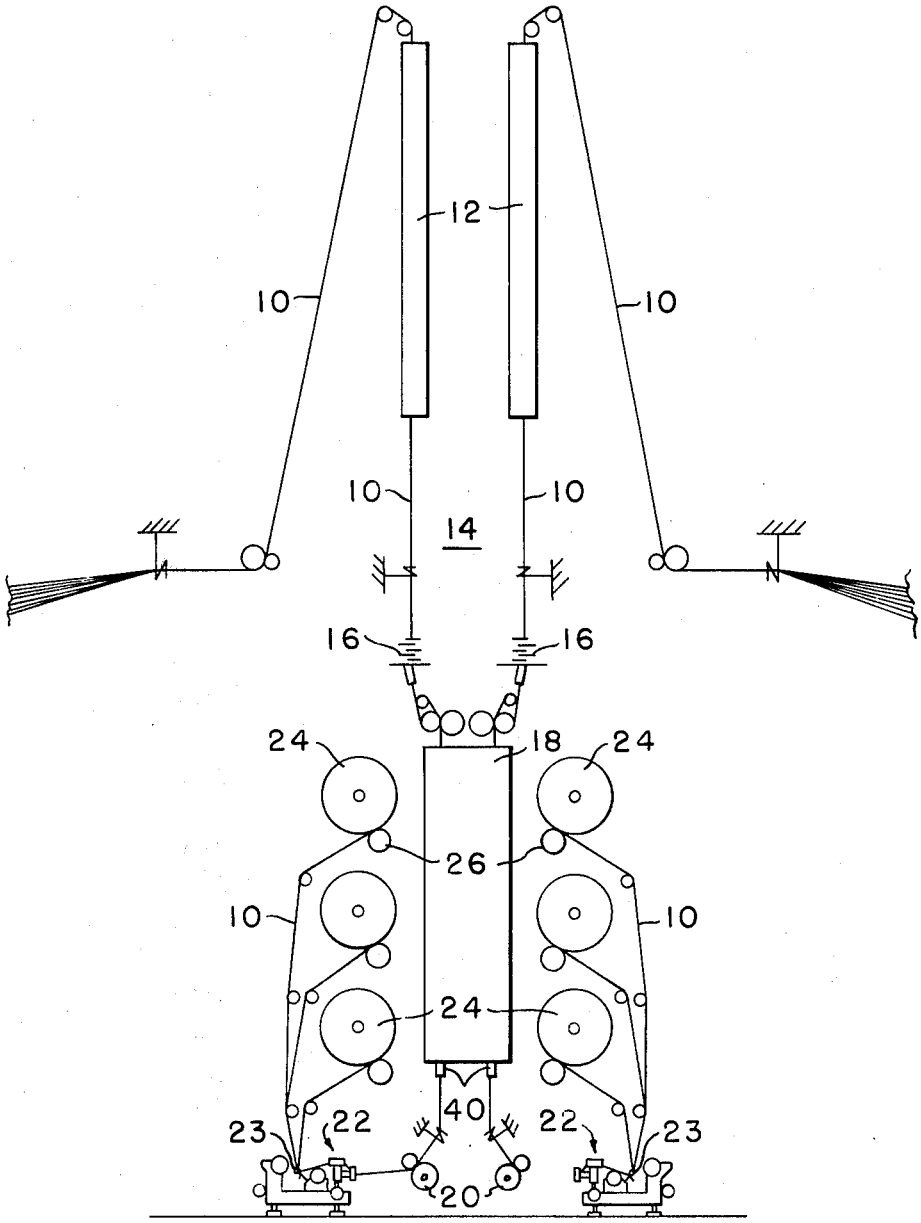
FIG. 1 is a side schematic view of a combination false twist — co-mingling yarn producing machine.

Looking now to FIG. 1, a conventional false twist machine for continuous multifilament synthetic yarn 10 is schematically represented. Each of the yarns 10 are supplied from creels (not shown) over suitable rolls to individual positions which are identical to that represented in FIGS. 1–5. The yarn 10 is supplied initially down through the primary heater 12 through a cooling zone 14 to the false twist devices 16, represented as friction discs. From the false twist devices 16, the yarn 10 then passes over feed rolls then downwardly through the secondary heater 18 in the intermediate feed system to the nip rolls 20. From the nip rolls 20, the yarn 10 passes through the co-mingling air jet 22, wherein the individual filaments of the yarn 10 are co-mingled, as described, for example in U.S. Pat. No. 4,011,640, and is delivered through guide eyelet 23 to the yarn package 24 which is driven by surface drive roll 26.

As described, the apparatus is of the type wherein false-twisted yarn is co-mingled in the same machine to produce a false-twisted intermingled yarn. As disclosed, the resultant co-mingled or inter-mingled yarn 10 is single ply but, obviously more than one false-twisted yarn 10 can be supplied to a single air jet 22 to provide a plied, false-twisted, co-mingled yarn. Preferably, the air jet 22 (see FIG. 5) is of the general type shown in FIGS. 1–7 of U.S. Pat. No. 4,011,640, supra, in that air under pressure from conduit 28 is fed into the jet through an opening 30, the center line of which is substantially perpendicular to the center line of the yarn passage 32 of the jet 22. The yarn passage 32 is defined basically by a metal cylinder 34 and a metallic outlet collar 36 secured in a suitable plastic housing 39.

Figure 2:
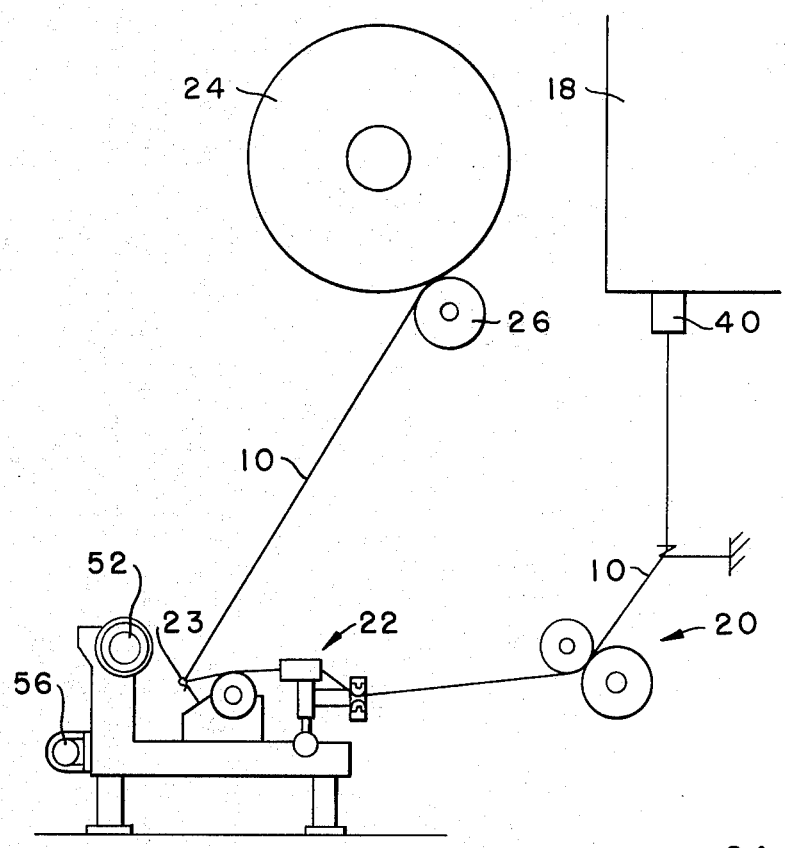
FIG. 2 is an enlarged view of the yarn co-mingling jet and take-up portion of the machine shown in FIG. 1.
Figure 3:
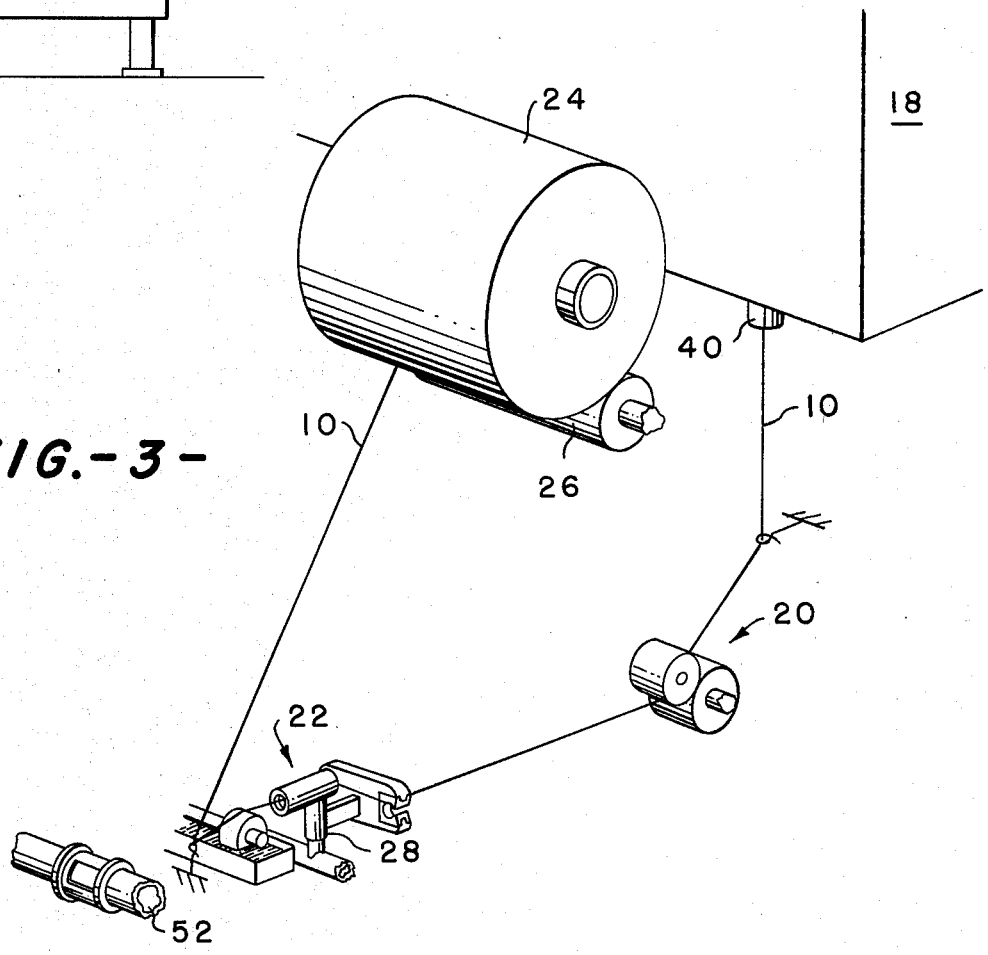
FIG. 3 is a perspective view of portions of the machine shown in FIG. 2.

Looking now to FIG. 2, one yarn position is shown in the winding position as described above with the yarn 10 exiting from the tube 40 at the bottom of the secondary heater 18 and being wound on the package 24. When the package 24 has reached the desired diameter, it is desired to doff the package 24 while simultaneously allowing the yarn position to continue to run without losing the yarn end. In the described apparatus, it has been found that when using a perpendicular air opening 30 that there is not sufficient pull on the yarn at the outlet of the air jet 22 to effectively pull the yarn through the jet as it is being supplied from the nip rolls 20 when the yarn 10 has been disconnected from the package 24 as the package is being doffed and being replaced with an empty cone for further winding.

Figure 4:
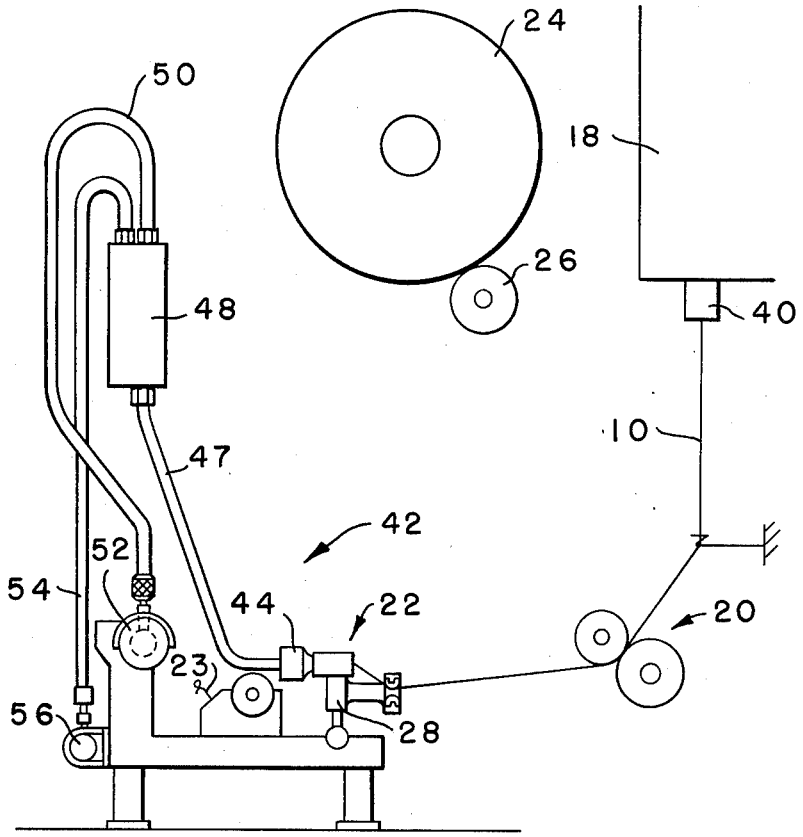
FIG. 4 is a side view similar to FIG. 2 showing one position ready to be doffed.
Figure 5:
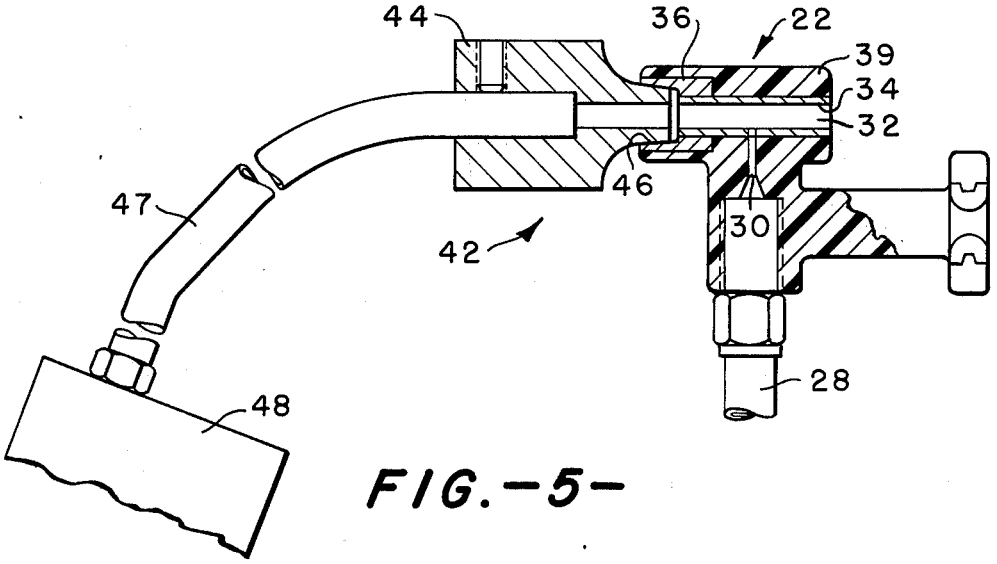
FIG. 5 is a cross-section view of the yarn co-mingling jet and suction device of FIG. 4.

To accomplish the above result, a suction device 42, as shown in FIGS. 4 and 5, is employed to break the yarn 10 at the air jet nozzle 22 and direct the yarn from the nip rolls 20 to a waste collection point (not shown) until the package 24 has been doffed and replaced with an empty tube for further winding. The suction device 42 basically consists of a suction nozzle 44, tapered at 46, to conform to the internal outward shape of the inside of the outlet collar 36 of the air jet, a hose connection 47, a pressure chamber 48, a suction hose 50 adapted to be connected to the vacuum waste manifold 52 and a pressure hose 54 connected to the air pressure conduit 56.

The nozzle 44 could be connected directly to the suction waste manifold 52 but preferably is connected to the pressure chamber 48 which has nozzle therein (not shown) which is supplied with air under pressure from the hose 54 to increase the available suction pressure in the suction hose connection 47.

DOFF OPERATION CYCLE

When the package 24 has reached the desired diameter, e.g. as in FIG. 2, the vacuum hose 50 will be connected into the suction waste manifold 52 and the pressure hose 54 will be connected to the air pressure manifold 56. Then the suction device 42 will be inserted into the collar 36 so that tapered portion 46 meshes with the interior thereof. The yarn 10 going to the package 24 is then trapped and cut-off by the engagement of tapered portion 46 with the inside of collar 36 and the end of insert 34. The yarn from the nip rolls 20 will then be directed to waste through the nozzle 44, hose 47, pressure chamber 48, hose 50 and manifold 52. The package 24 can then be doffed and replaced by an empty cone or bobbin. Then the suction device 42 is grasped and pulled outwardly from the air jet 22 guiding the yarn into the eyelet and up to the winding position where several wraps are placed on the new cone or bobbin. The suction device 42 can then be moved to another position for doffing another package when desired.

It can readily be seen that the disclosed improvement will allow doffing of a position of a yarn producing or modifying machine without stopping the flow of yarn from the position being doffed. Although the preferred embodiment of the invention has been described, it is contemplated that changes may be made without departing from the scope or spirit of the invention and I desire to be limited only by the scope of the claims.

I claim:

1. The method of doffing a combination of a false twist and co-mingling multifilament yarn producing machine having a co-mingling air jet downstream from a false twist producing device comprising the steps of: inserting a suction nozzle into the outlet end of the air jet to cut off the end of yarn being produced and direct the yarn being produced to a waste collection point, doffing a completed package while the yarn is being directed to the waste collection point, placing an empty yarn container on the take-up mechanism and moving the nozzle adjacent the empty yarn container to place the yarn being produced on the empty yarn container.

* * * * *